US005316284A

United States Patent [19]

Bolognese et al.

[11] Patent Number: 5,316,284

[45] Date of Patent: May 31, 1994

[54] DEVICE FOR FEEDING SINGLE SHEETS OUT OF A STACK OF FILM SHEETS

[75] Inventors: Renato Bolognese, Savona; Marco Notini, Genova Pegli; Gian C. Pastorino, Mallare, all of Italy

[73] Assignee: Minnesota Mining and Manufacturing Company, St. Paul, Minn.

[21] Appl. No.: 908,152

[22] Filed: Jul. 2, 1992

[30] Foreign Application Priority Data

Jul. 3, 1991 [IT] Italy ..... MI91A001835

[51] Int. Cl.[5] ..... B65H 3/52

[52] U.S. Cl. ..... 271/121; 271/126; 271/167

[58] Field of Search ..... 271/121, 126, 127, 129, 271/137, 138, 167

[56] References Cited

U.S. PATENT DOCUMENTS

| | | | |
|---|---|---|---|
| 615,502 | 12/1898 | Shade | 271/121 |
| 2,705,636 | 4/1955 | Bombard | 271/124 |
| 3,895,791 | 7/1975 | Kramell et al. | 271/167 |
| 3,955,092 | 5/1976 | Hubert | 250/468 |
| 3,961,785 | 6/1976 | Gall | 271/119 |
| 3,986,712 | 10/1976 | Hasegawa | 271/167 |
| 4,039,181 | 8/1977 | Prewer | 271/10 |
| 4,346,879 | 8/1982 | Ruenzi | 271/121 |
| 4,362,296 | 12/1982 | Schmidt | 271/121 |
| 4,365,793 | 12/1982 | Van Blokland et al. | 271/3.1 |
| 4,568,074 | 2/1986 | Murayoshi | 271/167 |
| 4,585,223 | 4/1986 | Tam | 271/167 |
| 4,635,922 | 1/1987 | Roetter et al. | 271/121 |
| 4,765,605 | 8/1988 | Abbott | 271/147 |
| 5,120,042 | 6/1992 | Goto et al. | 271/121 |

FOREIGN PATENT DOCUMENTS

| | | | |
|---|---|---|---|
| 574278 | 4/1959 | Canada | 271/129 |
| 0345468 | 5/1989 | European Pat. Off. . | |
| 648721 | 7/1937 | Fed. Rep. of Germany . | |
| 1066085 | 9/1959 | Fed. Rep. of Germany . | |

*Primary Examiner*—David H. Bollinger

*Attorney, Agent, or Firm*—Gary L. Griswold; Walter N. Kirn; Mark A. Litman

[57] ABSTRACT

Device for feeding single sheets out of a stack of film sheets while avoiding the risk of artifacts. The device comprises a housing for housing the stack of film sheets, a driven feed roller in contact with the first film sheet of the stack, biasing means for keeping the stack with its first film sheet in contact with the feed roller, and a withdrawal passageway for the film sheets, characterized in that the passageway is defined by a first guide surface forming an angle of 30° to 60° with the sheets of the stack and a second rounded guide surface, the passageway has a height at least twice the thickness of a single film sheet, and the feed roller has an outer surface comprising a material which provides a coefficient of static friction between that material and a film sheet which is greater than the coefficient of static friction between two adjacent film sheets of the stack.

5 Claims, 1 Drawing Sheet

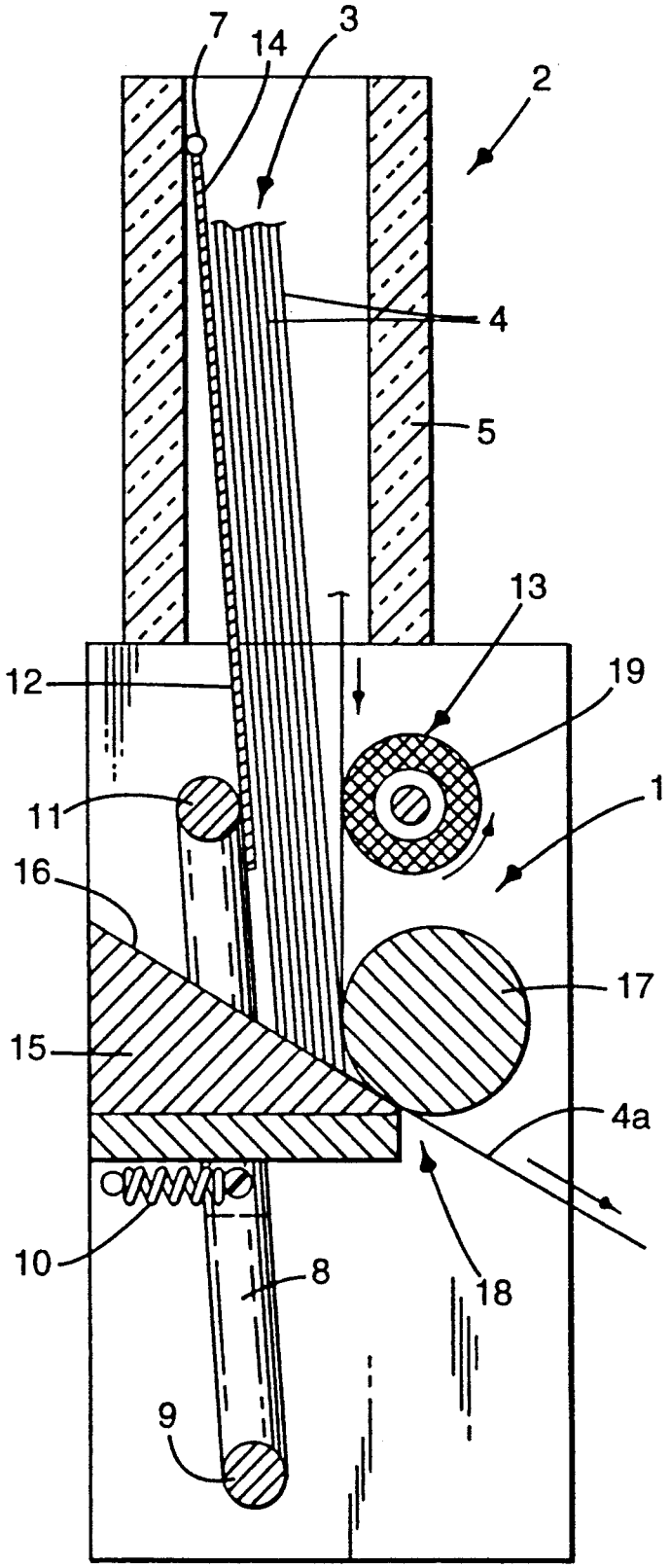
7
14
3
2
4
5
13
12
19
11
1
16
17
15
4a
10
8
18
9

DEVICE FOR FEEDING SINGLE SHEETS OUT OF A STACK OF FILM SHEETS

BACKGROUND OF THE INVENTION

1. Field of the Invention

The present invention relates to a device for feeding single film sheets out from a stack of film sheets, particularly for use in a feed magazine for an X-ray film apparatus.

2. Background of the Invention

A feeding device for film sheets must ensure both that only a single sheet is fed at a time and that no artifacts are caused on the film sheet, such as scratches, pressure marks, static marks etc.

Many devices are known which make use of vacuum suction to pick up a film from the stack, but this solution is considered too complex and expensive.

Other known devices are based on a calibrated withdrawal slot, which has a width that allows the exit of only one film at a time. An example is given by U.S. Pat. No. 4,365,793, in which the film sheet is driven by a friction roller through the slot.

Other devices make use of a calibrated pushing claw or the like, which engages the edge of only one film at a time. An example is given by U.S. Pat. No. 3,955,092, in which film bending assists in the separation of the film from the stack.

Another known device is shown by U.S. Pat. No. 3,961,785. That device makes use of both a calibrated withdrawal slot and a calibrated pushing claw.

It has been found that known devices not only are too complex and expensive, but also very often cause damage to the film sheets. In particular, film sheets can easily be scratched while passing through a calibrated slot, since at least one side of the slot must be sharply angled to ensure film to film separation. Also pushing claws may easily scratch the film adjacent the film being pushed.

BRIEF DESCRIPTION OF THE INVENTION

In accordance with the present invention, a device is proposed for feeding single sheets out of a stack of film sheets, while avoiding the risk of artifacts. The device comprises housing means for housing the stack of film sheets, a driven feed roller in contact with the first film sheet of the stack, biasing means for keeping the stack with its first film sheet in contact with the feed roller, and a withdrawal passageway for the film sheets, characterized in that the passageway is defined by a first guide surface forming an angle of 30° to 60° with the sheets of the stack and a second rounded guide surface. The passageway has a height at least twice the thickness of a single film sheet, and the feed roller has an outer surface comprising a material which provides a coefficient of static friction between that material and a film sheet which is greater than the coefficient of static friction between two adjacent film sheets of the stack.

BRIEF DESCRIPTION OF THE DRAWING

The FIGURE shows a side view of a feeding device of the present invention.

It has been verified that such a device provides very reliable feeding of single film sheets, avoiding the risk of artifacts. Indeed, the contact between the film sheet and the device is always smooth, both at the feed roller and at the withdrawal passageway. No sharp angled elements are used to provide sheet to sheet separation.

The biasing means may comprise, for example, a spring and a lever, the spring being compressed between the lever and the housing, the lever pushing against the stack towards the feed roller.

Preferably, the material of which the external portion of the feed roller is made is a suitable rubber or elastomer, having a hardness of 10 to 100 shore, and more preferably of 30 to 60 shore.

Preferably, the stack is housed in the housing means in a substantially vertical position (with the major surfaces of the films lying vertically), to make the movement of the sheets of the stack easier.

Further features and advantages of a device according the invention will be shown in the following description of a preferred embodiment, of which a cross-sectional schematic view is shown in the enclosed drawing.

A feeding device (1)1 is shown in the drawing as a part of a magazine (2) for housing a stack (3) of film sheets (4). Preferably, the magazine (2) is placed in a substantially vertical position, i.e. a position in which the film sheets (4) form an angle of less than 15° with the vertical.

The magazine (2) comprises a rigid housing (5), provided with means (not shown) for connecting the magazine (2) to an apparatus for handling the film sheets (4); both the apparatus and the connecting means are not shown, not being part of the invention.

Within the housing (5), there are provided a plate (6), hinged to the housing (5) by means of a pin (7), and a lever (8), hinged to the housing (5) by means of a further pin (9). A spring (10) is compressed between the lever (8) and a fixed location in the housing, so that an end portion (11) of the lever (8) is biased against a back face (12) of the plate (6).

The magazine (2) further comprises a feed roller (13), mounted on the housing (5) opposite to a front face (14) of the plate (6), in correspondence of the end portion of the lever (8). The feed roller (13) may be cylindrical (as shown in the drawing) or have a different shape. For example the shape may be that of a cylinder cut by a plane parallel to the axis of the cylinder.

The feed roller (13) is connected to drive means (not shown) which can cause the feed roller to rotate when and how it is necessary. The stack (3) of film sheets (4) is lodged against the front face (14) of the plate (6), pressed against the feed roller (13) by the action of the spring (10).

A fixed wedge (15) is mounted in the magazine (2) beneath the stack (3) of film sheets (4). The wedge (15) has a first guide surface (16) confronting the stack (3); the surface (16) and the film sheets (4) form an angle between 30° and 60°.

A second rounded guide surface, for example an idle roller (17), is mounted in the housing (5) in front of the surface (16), defining therewith a withdrawal passageway (18) for the film sheets (4). The reciprocal position of the roller (17) and the wedge (15) is such that the passageway (18) has a width of at least two (preferably from two to four) times the thickness of a single film sheet (4). Idle roller (17) may be easily replaced by a fixed guide surface, rounded enough to ensure a smooth contact with the film sheets (4).

The feed roller (13) has an outer surface (19) made of a material which provides a coefficient of static friction between the material and a film sheet (4) which is higher than the coefficient of static friction between two adjacent film sheets (4) of the stack (3). Such material may be a suitable rubber, polymer or elastomer, for example a rubber having a hardness comprised between 10 and 100 shore, preferably between 30 and 60 shore.

In operation, when a film sheet (4) is to be fed, feed roller (13) is driven to rotate (in counterclockwise direction, looking at the drawing). The first film sheet (4*a*) of the stack (3), i.e. the film in contact with the feed roller (13), is then caused to slip over the adjacent film sheet, since the coefficient of static friction is greater with the feed roller (13). Film sheet (4*a*) is then pushed against the first guide surface (16), over which it bends, entering the passageway (18). Bending of the film (4*a*) is controlled by the guide roller (17). Film sheets (4) other than the first sheet (4*a*) remain at rest against the first guide surface (16), since the pushing action transmitted by friction through the first sheet (4*a*) is not sufficient to cause bending against the guide surfaces (16) and (17).

Action of the spring (10), via the lever (8), causes the stack (3) to be always kept in contact with the feed roller (13), despite the number of film sheets (4) of the stack (3).

It has been verified that the device (1) allows easy and reliable feeding of film sheets (4). Tests at very different humidity conditions (from 25% to 80% relative humidity) have given very positive results, showing an absence of artifacts of any kind, the absence of jamming, and practically no double feeding (only very few cases in the worst humidity conditions, e.g. at 80% of relative humidity).

Moreover, it is self evident that the device of the invention is less complex than other known feeding devices. This simplicity results not only in low costs, but also in very high reliability over time.

We claim:

1. Device for feeding single sheets out of a stack of film sheets, comprising housing means (5) for housing the stack of film sheets in a substantially vertical position within 15 degrees of vertical, a driven feed roller in contact with the first film sheet of the stack, biasing means for keeping the stack with its first film sheet in contact with the feed roller, and a withdrawal passageway for the film sheets, characterized in that the passageway is defined by a first guide surface forming with the sheets of the stack an angle of 30° to 60° and a second rounded guide surface, said passageway having an opening height of at least twice the thickness of a single film sheet, and the feed roller having outer surface of a material providing a coefficient of static friction between the material and a film sheet greater than the coefficient of static friction between two adjacent film sheets of the stack.

2. Device according to claim 1, characterized in that the biasing means comprises a spring and a lever, the spring being compressed between the lever and the housing, the lever pushing against the stack towards the feed roller.

3. Device according to claim 1, characterized in that the material of the feed roller is a rubber having a shore hardness of 10 to 100.

4. Device according to claim 1, characterized in that the height of the withdrawal passageway is between two and four times the thickness of a single film sheet.

5. The device of claim 1 wherein said film sheets are X-ray film.

* * * * *